US008200141B2

(12) United States Patent
Matsushima et al.

(10) Patent No.: US 8,200,141 B2
(45) Date of Patent: Jun. 12, 2012

(54) CONVEYING UNIT FOR IMAGE FORMING APPARATUS

(75) Inventors: Toshihiro Matsushima, Shizuoka (JP); Kazumasa Yasui, Tokyo (JP); Masataka Muratani, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 422 days.

(21) Appl. No.: 12/553,762

(22) Filed: Sep. 3, 2009

(65) Prior Publication Data

US 2010/0061784 A1 Mar. 11, 2010

Related U.S. Application Data

(60) Provisional application No. 61/095,688, filed on Sep. 10, 2008.

(51) Int. Cl.
*G03G 15/00* (2006.01)

(52) U.S. Cl. ..... 399/381; 399/361

(58) Field of Classification Search ..... 399/381
See application file for complete search history.

(56) References Cited

U.S. PATENT DOCUMENTS

| | | | | |
|---|---|---|---|---|
| 4,570,923 | A * | 2/1986 | Hooper et al. | 271/275 |
| 5,307,116 | A * | 4/1994 | Ikunami et al. | 399/18 |
| 6,145,828 | A * | 11/2000 | Arai | 271/3.03 |
| 2005/0152726 | A1 * | 7/2005 | Ueda et al. | 400/56 |
| 2007/0057448 | A1 * | 3/2007 | Hiura | 271/273 |

* cited by examiner

*Primary Examiner* — Anthony Nguyen
(74) *Attorney, Agent, or Firm* — Patterson & Sheridan, LLP

(57) ABSTRACT

An interlock switch is switched according to the movement of a relay reversal unit rather than the movement of a front cover. The relay reversal unit is connected to a driver substrate by a drawer connector. The change-over of the interlock switch according to the movement of the relay reversal unit is turned off when margin time elapses after a cover detection switch is turned off.

16 Claims, 8 Drawing Sheets

SW OFF MARGIN AT THE TIME
WHEN RELAY REVERSAL UNIT IS DRAWN OUT

CONVEYING UNIT FOR IMAGE FORMING APPARATUS

CROSS-REFERENCE TO RELATED APPLICATION

This application is based upon and claims the benefit of priority from Provisional U.S. Application 61/095,688 filed on Sep. 10, 2008, the entire contents of which are incorporated herein by reference.

TECHNICAL FIELD

The present invention relates to a sheet conveying unit for an image forming apparatus that prevents fall in productivity due to maintenance and takes into account safety during the maintenance in a copying machine, a multifunction peripheral, or the like.

BACKGROUND

There is an image forming apparatus that turns off, in association with operation for opening an armor cover, an interlock switch that locks driving of the image forming apparatus. In the image forming apparatus that switches the interlock switch with the armor cover, when it is attempted to replace a toner cartridge during image forming operation, the interlock switch is turned off at a point when the armor cover is opened. As a result, the image forming operation of the image forming apparatus is stopped and productivity falls.

On the other hand, there is an image forming apparatus that switches an interlock switch using a sheet conveying unit rather than an armor cover and prevents fall in productivity of the image forming apparatus. There is a sheet conveying unit in which a sheet conveying unit motor is connected to a driver in a plug-in system to realize a reduction in size and cost. In the sheet conveying unit of the plug-in system, when a plug suddenly slips off during driving of the motor, plug slip-off detection of the driver is locked to cause breakage of a driver substrate.

Therefore, when the interlock switch is switched by using the sheet conveying unit of the plug-in system, when the interlock switch is suddenly turned off while the motor is driving, it is likely that the driver determines that the plug of the sheet conveying unit slips off, locks the plug slip-off detection, and damages the driver substrate.

There is a demand for development of a sheet conveying unit for an image forming apparatus that can realize improvement of productivity of the image forming apparatus and a reduction in size and cost of the sheet conveying unit and obtain safety during maintenance while preventing breakage of a driver substrate of the sheet conveying unit.

SUMMARY

According to an aspect of the invention to realize a reduction size and cost of an apparatus, prevent fall in productivity due to maintenance, and obtain safety during the maintenance while preventing breakage of a driver substrate of a sheet conveying unit.

According to an embodiment a sheet conveying unit for an image forming apparatus, including: a first conveying unit that moves in a first direction with respect to an apparatus main body; a second conveying unit that moves in a second direction with respect to the apparatus main body; a first switch that detects attachment and detachment of the first conveying unit to and from the apparatus main body; a second switch that locks driving of the first conveying unit and the second conveying unit; a first actuator that actuates the first switch according to the movement of the first conveying unit; and a second actuator that turns off the second switch after turning-off operation for the first switch by the first actuator, according to the movement of the first conveying unit to remove the first conveying unit inserted in the apparatus main body.

DETAILED DESCRIPTION

Figure 1:
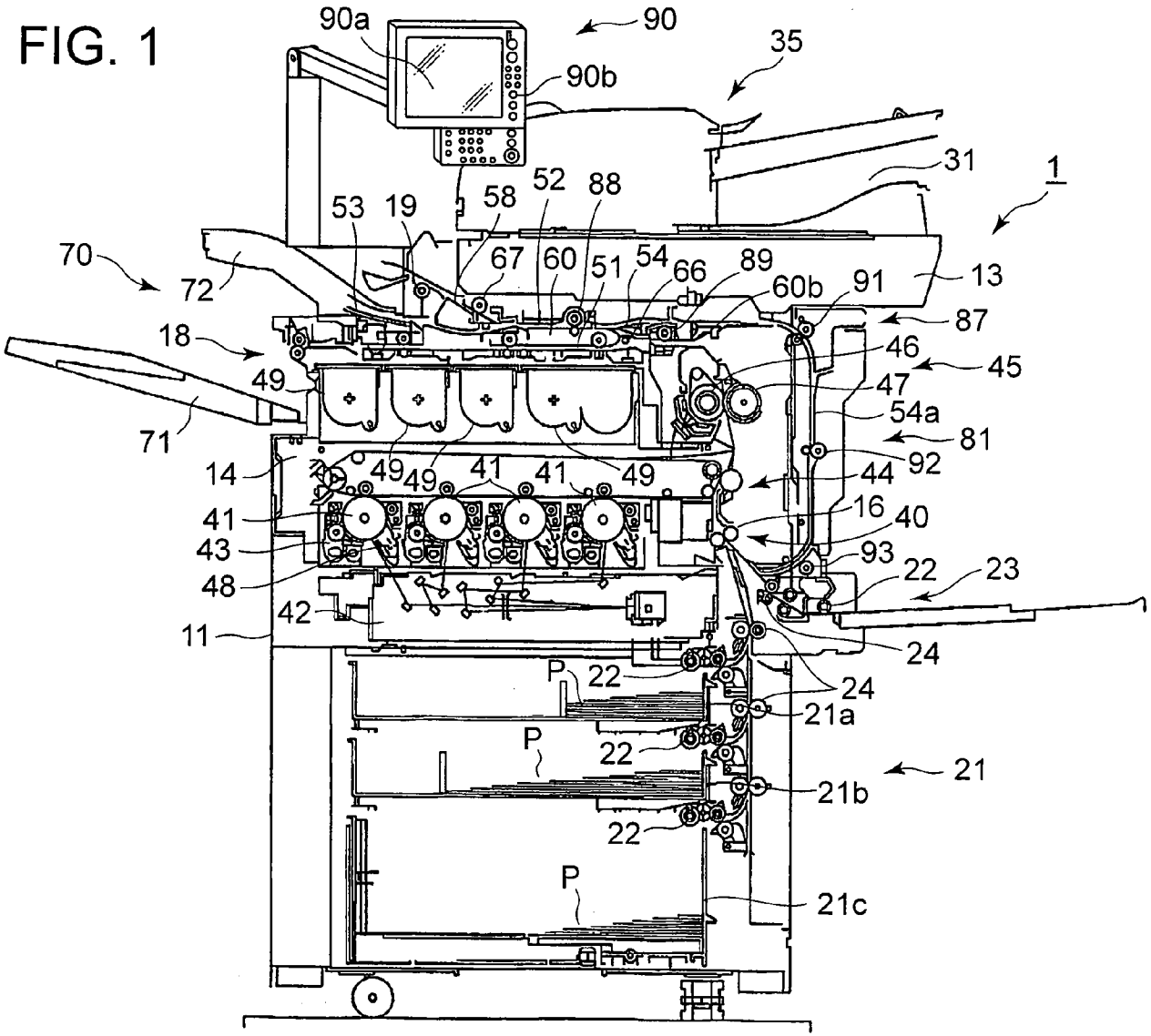
FIG. 1 is a schematic structural view of a copying machine according to an embodiment.

An embodiment is explained below. FIG. 1 is a schematic diagram of a copying machine 1 as an image forming apparatus according to the embodiment. The copying machine 1 includes a scanner unit 13 that reads an image, a printer unit 14 as an image forming unit, a paper feeding unit 21 that feeds a sheet P, and a paper discharging unit 70 including a first tray 71 and a second tray 72 in which the sheets P discharged from the printer unit 14 are accumulated. A manual paper feeding unit 23 is provided on a side of a housing 11, which is an apparatus main body forming an outer hull of the copying machine 1. A conveying path 40 for the sheet P is provided in a section leading from the paper feeding unit 21 or the manual paper feeding unit 23 to a relay reversal unit 60 as a first conveying unit or a duplex paper feeding unit 81 as a second conveying unit through the printer unit 14 of the copying machine 1. The relay reversal unit 60 and the duplex paper feeding unit 81 configure a sheet conveying unit 87. The relay reversal unit 60 moves in a front direction of the housing 11, which is a first direction. The duplex paper feeding unit 81 moves in a side direction of the housing 11, which is a second direction. A control panel 90 is provided in the housing 11.

The scanner unit 13 scans an original document, which keeps image information, fed from an auto document feeder (ADF) 35 and captures the image information as image data. After the scanner unit 13 finishes reading the image information, the ADF 35 discharges the original document to a document discharging unit 31.

The printer unit 14 forms, on the sheet P, an image corresponding to input image information or the image information read by the scanner unit 13. The printer unit 14 includes photoconductive drums 41, charging devices 48 that uniformly charge the photoconductive drums 41, an exposing device 42 that forms electrostatic latent images on the photoconductive drums 41, developing devices 43 that develop the electrostatic latent images formed on the photoconductive drums 41, a transfer device 44 that transfers toner images developed on the photoconductive drums 41 onto the sheet P of an arbitrary size, and a fixing device 45 that fixes the toner images on the sheet P on which the toner images are transferred by the transfer device 44. The fixing device 45 includes a fixing roller 46 and a press roller 47. The printer unit 14 includes toner cartridges 49 that supply toners to the developing devices 43. The toner cartridges 49 can be replaced from a front side of the apparatus main body 11.

The paper feeding unit 21 includes an upper paper feeding cassette 21*a*, a lower paper feeding cassette 21*b*, and a large capacity cassette 21*c*. The conveying path 40 includes conveying rollers 24 that feed the sheet P extracted from the paper feeding unit 21 or the manual paper feeding unit 23 by pickup rollers 22 to the transfer device 44, and registration rollers 16. The conveying path 40 conveys the sheet P, on which the toner images are fixed through the transfer device 44 and the fixing device 45, to an inlet 60*b* of the relay reversal unit 60.

Figure 2:
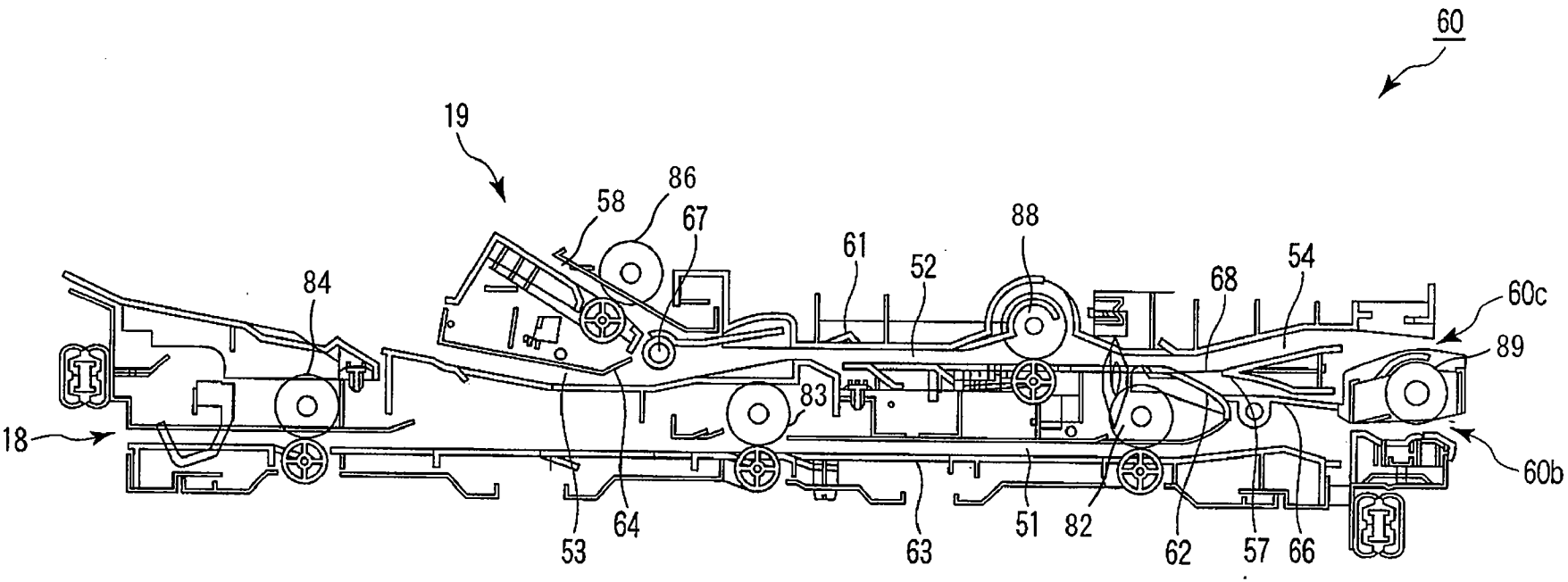
FIG. 2 is a schematic structural view of a relay reversal unit according to the embodiment.

The relay reversal unit 60 discharges the sheet P to the first tray 71 or the second tray 72 or reverses the sheet P. As shown in FIG. 2, the relay reversal unit 60 includes a first conveying path 51, a second conveying path 52, a third conveying path 53, a fourth conveying path 54, and a fifth conveying path 58. A first gate 66 divides the first conveying path 51 on the lower side and the second conveying path 52 on the upper side. The first conveying path 51 reaches the first tray 71 through a first discharge port 18. A second gate 67 divides the second conveying path 52 into the third conveying path 53 and the fifth conveying path 58. The third conveying path 53 is a reversal retracting path for the sheet P. The fifth conveying path 58 reaches the second tray 72 through a second paper discharge port 19.

A reversal film 68 and a third gate 57 lead the sheet P reversed on the second conveying path 52 to the fourth conveying path 54. The sheet P is led from the fourth conveying path 54 to the duplex paper feeding unit 81 through an entrance port 60*c*.

The relay reversal unit 60 includes an upper guide 61, an intermediate guide 62, and a lower guide 63. The intermediate guide 62 partitions the first conveying path 51 and the second conveying path 52. The fourth guide 64 partitions the third conveying path 53 and the fifth conveying path 58.

The relay reversal unit 60 includes lower sheet conveying rollers 82, 83, and 84 to convey the sheet P in the first conveying path 51, an upper sheet conveying roller 86 to convey the sheet P in the fifth conveying path 58, a reversal conveying roller 88 to reversely convey the sheet P in the second conveying path 52, and a sheet conveying roller 89 that feeds the sheet P into the duplex paper feeding unit 81.

Figure 3:
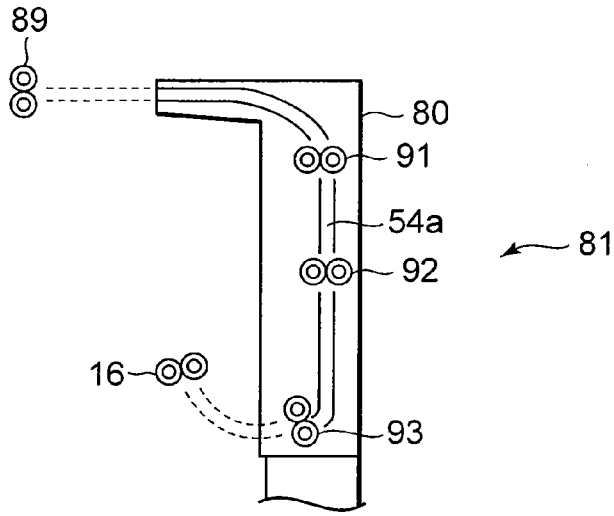
FIG. 3 is a schematic structural view of a duplex paper feeding unit according to the embodiment.

The duplex paper feeding unit 81 is provided above the manual paper feeding unit 23 on the side of the housing 11. The duplex paper feeding unit 81 feeds the sheet P, which is fed through the fixing device 45, to the transfer device 44 again. As shown in FIG. 3, the duplex paper feeding unit 81 includes a circulating path 54*a* and re-conveying rollers 91, 92, and 93 to convey the sheet P in the circulating path 54*a*.

Figure 4:
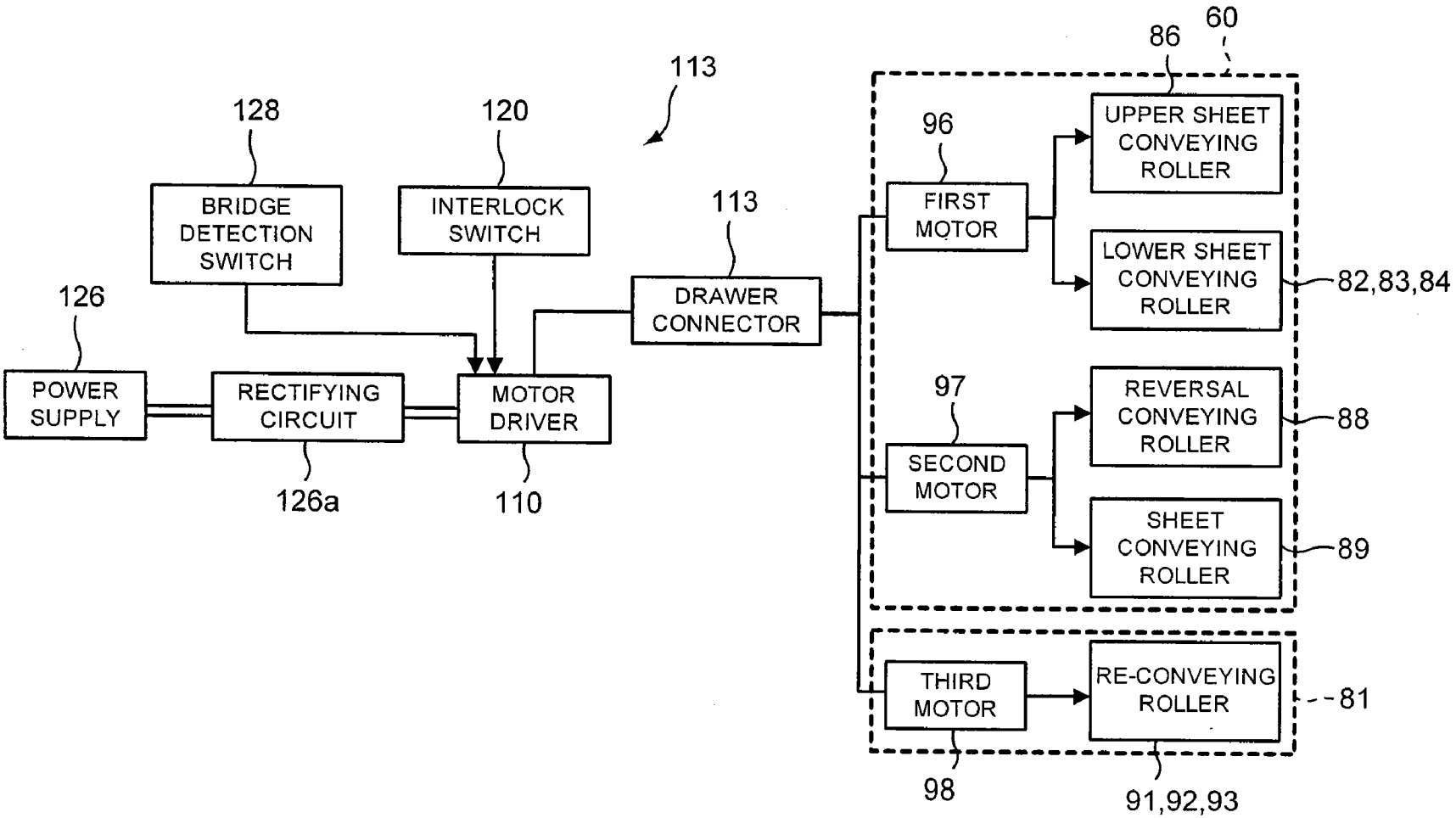
FIG. 4 is a schematic block diagram of a driving system for a sheet conveying unit according to the embodiment.

A block diagram of a driving system for the sheet conveying unit 87 is shown in FIG. 4. A driving system 130 for the sheet conveying unit 87 includes a motor driver 110. The motor driver 110 as a driving unit controls a first motor 96 and a second motor 97 for the relay reversal unit 60 and a third motor 98 for the duplex paper feeding unit 81.

The first motor 96 drives the lower sheet conveying rollers 82, 83, and 84 in the first conveying path 51 and the upper sheet conveying roller 86 in the fifth conveying path 58 of the relay reversal unit 60. The second motor 97 drives the reversal conveying roller 88, and the sheet conveying roller 89 to feed the sheet P into the duplex paper feeding unit 81. The third motor 98 drives the re-conveying rollers 91, 92, and 93 of the duplex paper feeding unit 81.

The motor driver 110 is connected to a power supply 126 via a rectifying circuit 126*a*. A detection result of a 5V bridge detection switch 128 as a first switch is input to the motor driver 110. The motor driver 110 stops 24V power supply for driving the first to third motors 96 to 98 when the bridge detection switch 128 is turned off. The bridge detection switch 128 detects whether the relay reversal unit 60 is inserted in the housing 11. The bridge detection switch 128 is turned on when the relay reversal unit 60 is inserted in the housing 11. The bridge detection switch 128 is turned off when the relay reversal unit 60 is drawn out from the housing 11.

A state of a 24V interlock switch 120 as a second switch is input to the motor driver 110. The motor driver 110 locks driving of the first to third motors 96 to 98 in order to maintain safety when the interlock switch 120 is off.

Figure 5:
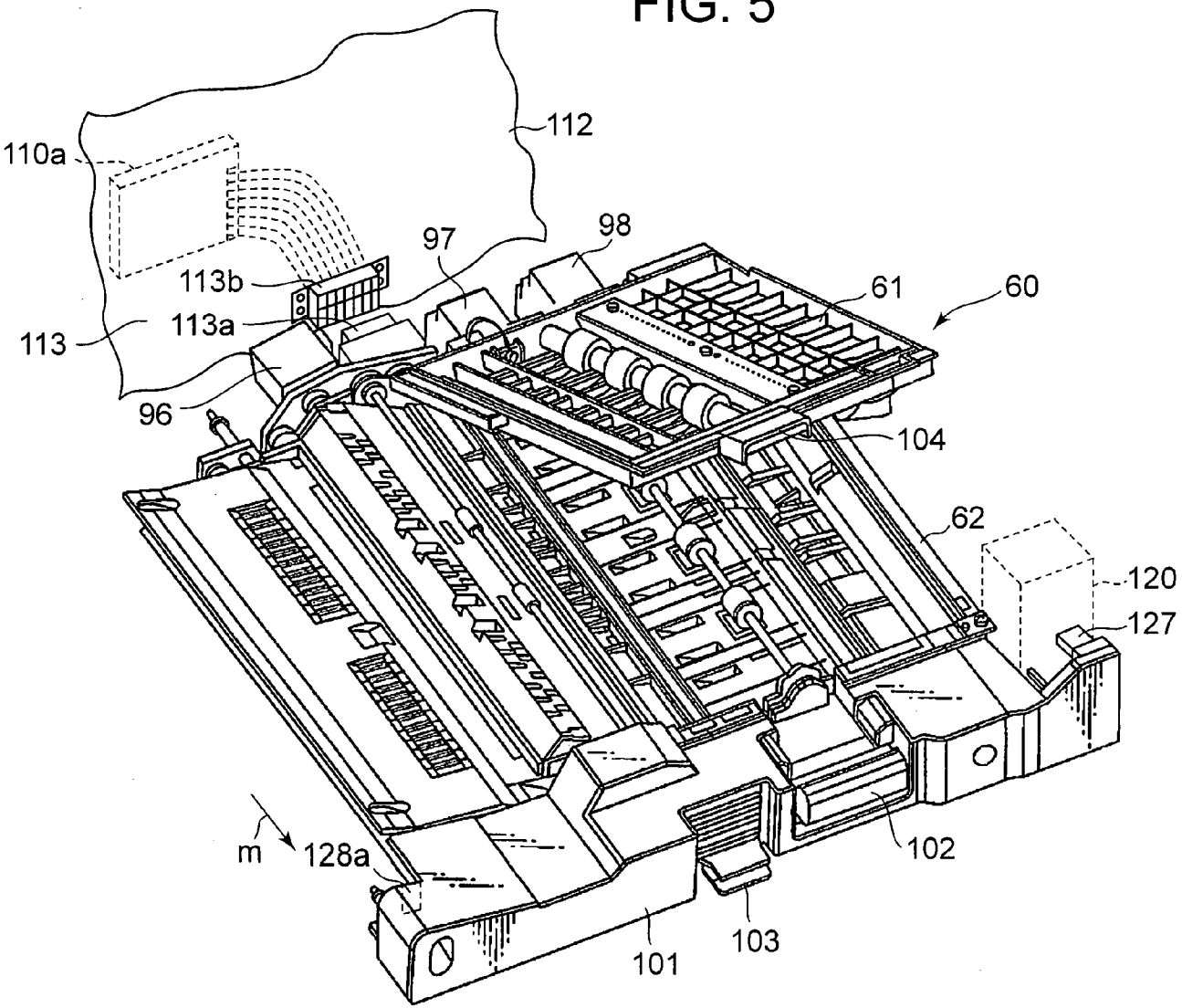
FIG. 5 is a schematic explanatory view of connection of the sheet conveying unit and the driving system according to the embodiment.

A driver substrate 110*a* of the motor driver 110 is arranged in a frame 112 on a rear side of the housing 11. The first to third motors 96 to 98 are mounted on the relay reversal unit 60. Connection of the driver substrate 110*a* and the first to third motors 96 to 98 is shown in FIG. 5. The first to third motors 96 to 98 are connected to the driver substrate 110*a* by a drawer connector 113 as a connection terminal of the plug-in system. The drawer connector 113 attaches and detaches a first connector terminal 113*a* provided on a rear side of the relay reversal unit 60 to and from a second connector terminal 113*b* supported on the frame 112 to connect and disconnect the driver substrate 110*a* and the first to third motors 96 to 98. When the drawer connector 113 is used for the connection of the driver substrate 110*a* and the relay reversal unit 60, a reduction in space and a reduction in cost can be obtained compared with drawing-around of wire harnesses and the like.

The first connector terminal 113*a* of the drawer connector 113 on the rear side of the relay unit 60 slips off from the second connector terminal 113*b*, when the relay reversal unit 60 is drawn out in an arrow m direction, which is a direction of a front side of the housing 11.

The bridge cover 101 of the relay reversal unit 60 supports a front side of the intermediate guide 62. The bridge cover 101 includes a drawing-out lever 102 to draw out the relay reversal unit 60. The relay reversal unit 60 includes a lock lever 103 that locks the lower guide 63 to the intermediate guide 62 and an opening and closing lever 104 that opens and closes the upper guide 61.

Figure 6:
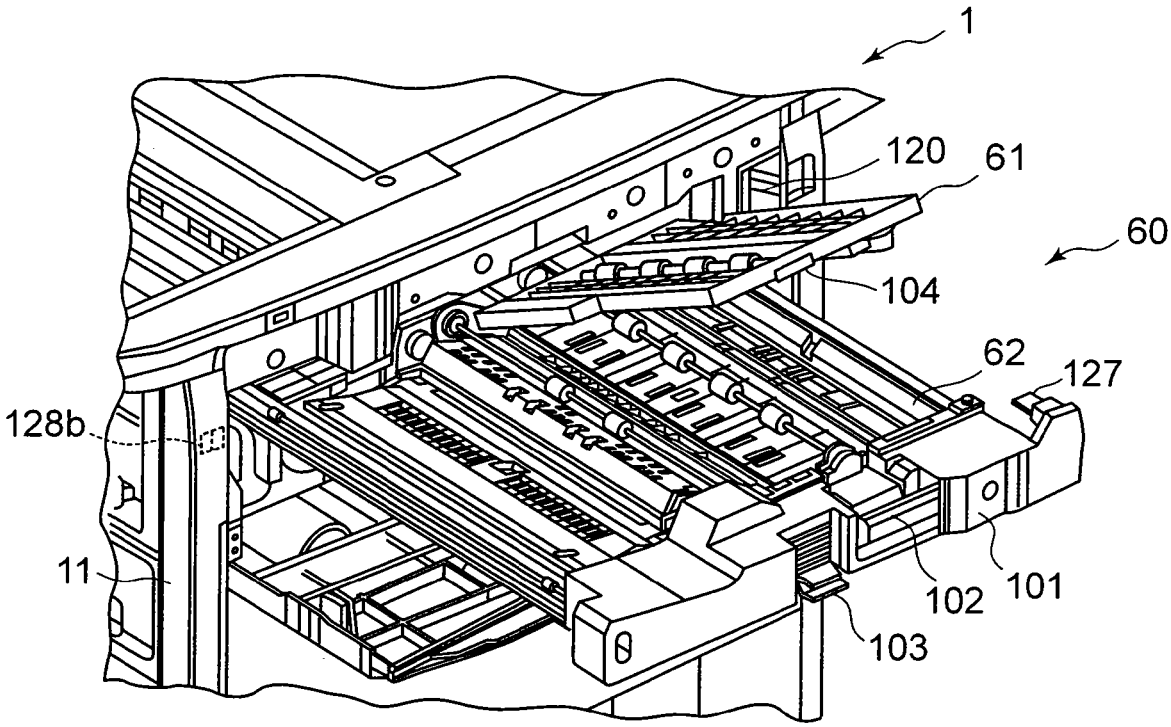
FIG. 6 is a perspective view of a state in which the relay reversal unit is drawn out from housing according to the embodiment.

A sheet metal 128*a* as a first actuator that actuates the bridge detection switch 128 is provided on a rear side of the bridge cover 101 The sheet metal 128*a* switches a terminal 128*b* of the bridge detection switch 128 provided on the left side of the housing 11 shown in FIG. 6. If the relay reversal unit 60 is inserted in the housing 11 and the sheet metal 128*a* is in contact with the terminal 128*b*, the bridge detection switch 128 is turned on. When the relay reversal unit 60 is drawn out from the housing 11 and the sheet metal 128*a* separates from the terminal 128*b*, the bridge detection switch 128 is turned off.

A first pusher 127 as a second actuator that switches the interlock switch 120 is provided on a rear side of the bridge cover 101. As shown in FIGS. 5 and 6, the interlock switch 120 is provided on the right side of the housing 11. When the relay reversal unit 60 is inserted in the housing 11, the first pusher 127 turns on the interlock switch 120. When the relay reversal unit 60 is drawn out from the housing 11 and the first pusher 127 separates from the interlock switch 120, the interlock switch 120 is turned off.

Figure 7:
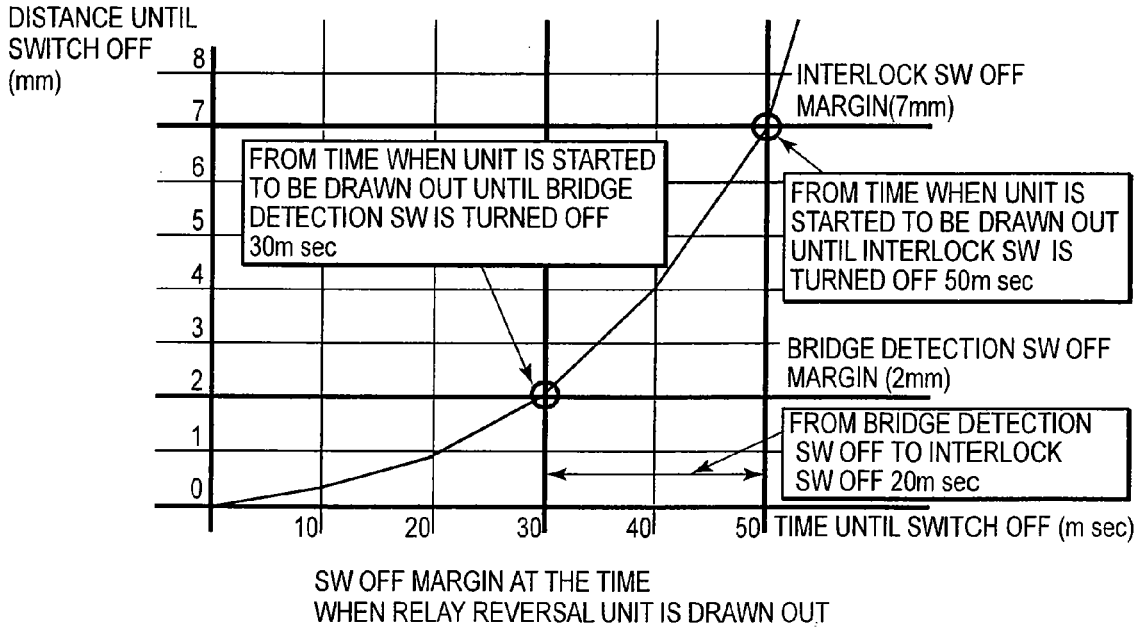
FIG. 7 is a graph of turning-off margins of a bridge detection switch and an interlock switch according to the embodiment.

Timing for switching of the bridge detection switch 128 by the sheet metal 128*a* and timing for switching of the interlock switch 120 by the first pusher 127 are different. For example, a margin of a distance from a position where the bridge detection switch 128 is turned off to a position where the interlock switch 120 is turned off when the relay reversal unit 60 is drawn out from the housing 11 is set to 5 mm as shown in FIG. 7. When an operator or the like draws out the relay reversal unit 60 from the housing 11, a margin of time from a point when the bridge detection switch 128 is turned off until the interlock switch 120 is turned off is about 20 msec as shown in FIG. 7. Time from a point when the relay reversal unit 60 is started to be drawn out from the housing 11 until the interlock switch 120 is turned off is about 50 msec.

When the relay reversal unit 60 is inserted in the housing 11, the bridge detection switch 128 is turned on in a position with a margin of 5 mm from a position where the interlock switch 120 is turned on. As a margin of time, when the operator starts operation to insert the relay reversal unit 60 and the interlock switch 120 is turned, the bridge detection switch 128 is turned on after about 20 msec.

A switching result of the bridge detection switch 128 is input to the motor driver 110. In a period of about 20 msec from a point when the bridge detection switch 128 is turned off according to the start of drawing-out of the relay reversal unit 60 from the housing 11 until the interlock switch 120 is turned off, the motor driver 110 stops the 24V power supply to the first to third motors 96 to 98.

Figure 8:
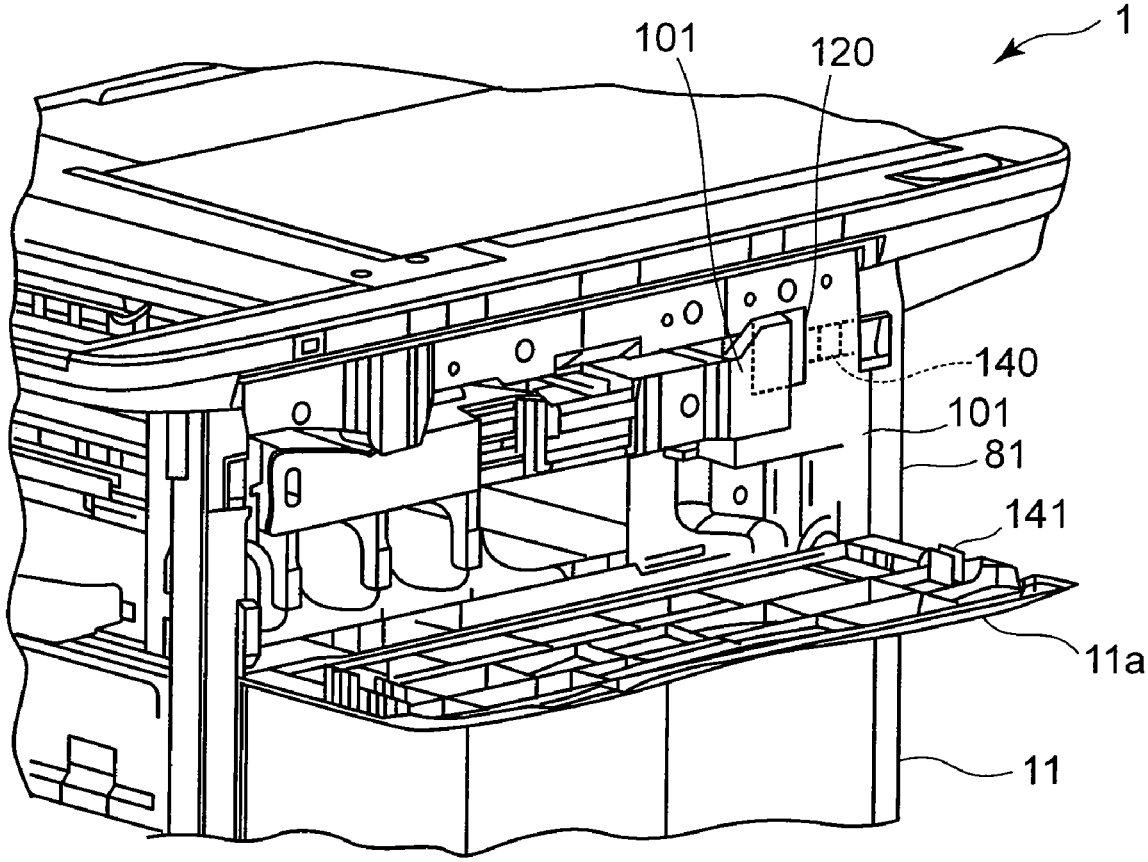
FIG. 8 is a partial schematic perspective view of a state in which a front cover is opened according to the embodiment.

As shown in FIG. 8, the housing 11 includes a front cover 11*a* that covers the printer unit 14 and the relay reversal unit 60 and a cover detection switch 140 as a third switch that detects the front cover 11*a*. The front cover 11*a* has a cover pusher 141 that switches the cover detection switch 140.

Figure 9:
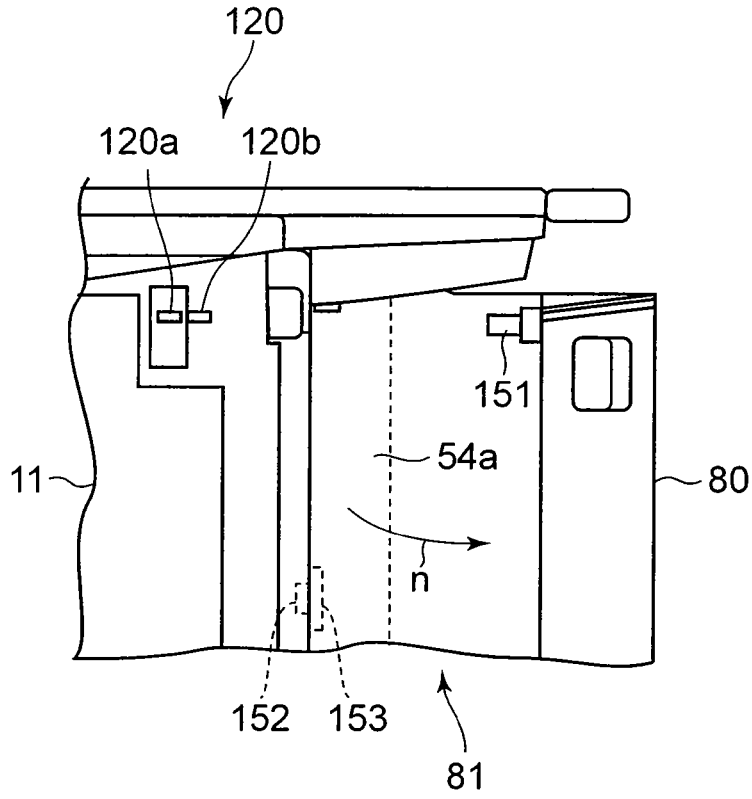
FIG. 9 is a partial schematic diagram for explaining a state in which a side cover is opened according to the embodiment.
Figure 10:
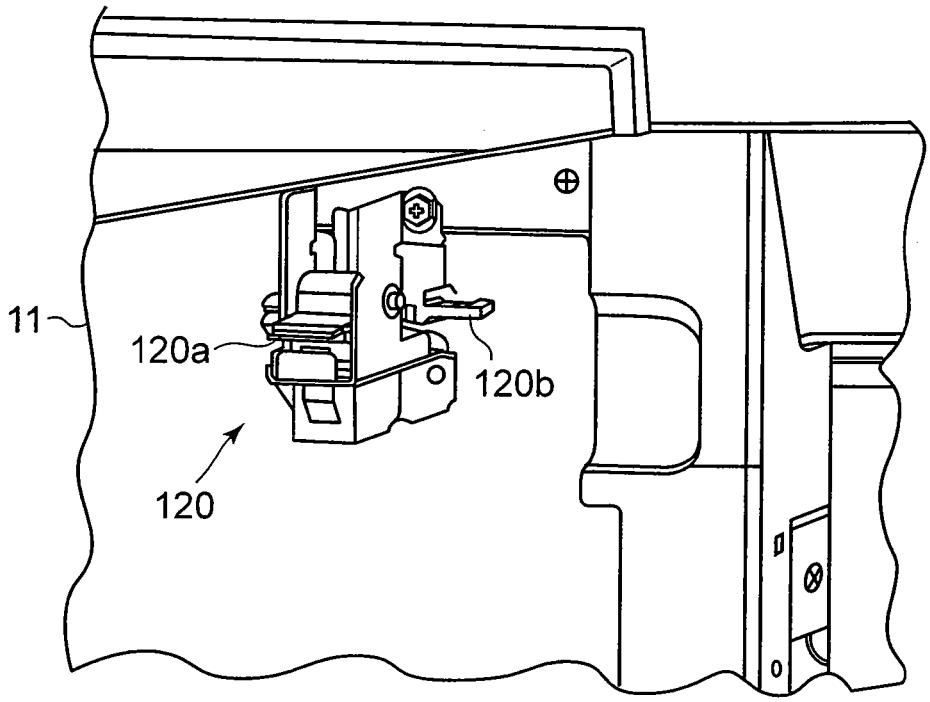
FIG. 10 is a schematic perspective view of an interlock switch according to the embodiment.

The interlock switch 120 provided on the right side of the housing 11 is switched by the first pusher 127 provided in the bridge cover 101. On the other hand, the interlock switch 120 is switched by a second pusher 151 provided in a side cover 80 of the duplex paper feeding unit 81 as shown in FIG. 9. The interlock switch 120 includes, as shown in FIG. 10, a first terminal 120*a* and a second terminal 120*b* switched by the second pusher switched by the first pusher 127 of the bridge cover 101 151 of the side cover 80.

As shown in FIG. 9, when a front side of the side cover 80 is rotated in an arrow n direction with a rear side thereof as a fulcrum to open a side of the housing 11, the second pusher 151 separates from the interlock switch 120 to turn off the interlock switch 120. When the side cover 80 is closed, the second pusher 151 turns on the interlock switch 120.

A duplex unit detection switch 152 is provided on a side of the housing 11. The duplex unit detection switch 152 detects whether the duplex paper feeding unit 81 is inserted in the housing 11. The duplex unit detection switch 152 is switched by a sheet metal switch 153 provided in the duplex paper feeding unit 81.

The control panel 90 includes a display unit 90*a* and a keyboard 90*b*. The control panel 90 has an input function to input conditions for image formation by the copying machine 1, start of the image formation, start of image reading by the scanner unit 13, and the like. The control panel 90 displays a confirmation screen for input information and the like, a down state of the copying machine 1, and the like.

For example, at the interlock switch 120 is on, when both the bridge detection switch 128 and the duplex unit detection switch 152 are on, the control panel 90 displays READY on the display unit 90*a*. However, when the cover detection switch 14 is off, the control panel 90 determines that the front cover 11*a* is not closed, for example, after the toner cartridges 49 are replaced in the printer unit 14, and displays CLOSE of the front cover 11*a* on the display unit 90*a*. At the interlock switch 120 is on, when the bridge detection switch 128 is off, the control panel 90 determines that the relay reversal unit 60 is not returned to a correct position, for example, after sheet jam treatment is performed, and displays CLOSE of the bridge cover 101 on the display unit 90*a*.

For example, at the interlock switch 120 is off, when both the bridge detection switch 128 and the duplex unit detection switch 152 are on, this is a situation that does not usually occur. The control panel 90 displays ERROR on the display unit 90*a*. At the interlock switch 120 is off, when the bridge detection switch 128 is off, the control unit 90 displays CLOSE of the bridge cover 101 on the display unit 90*a*.

When image formation is instructed in a state in which READY is displayed on the display unit 90*a* of the control panel 90, the copying machine 1 starts image forming operation and the charging devices 48 charge the photoconductive drums 41. The exposing device 42 outputs exposure light corresponding to image data that should be formed as an image on the photoconductive drums 41 that keep charges. The exposing device 42 irradiates the exposure light on the photoconductive drums 41 to form electrostatic latent images corresponding to the exposure light on the photoconductive drums 41. The electrostatic latent images formed on the photoconductive drums 41 are visualized by the developing devices 43. Toner images visualized on the photoconductive drums 41 are transferred onto the sheet P by the transfer device 44.

The sheet P is supplied from the paper feeding unit 21 or the manual paper feeding unit 23 and conveyed through the conveying path 40 and reaches the transfer device 44. The toner images transferred on the sheet P are fixed on the sheet P by the fixing device 45. The sheet P on which the toner images are fixed is conveyed to the relay reversal unit 60. The sheet P is discharged to the first tray 71 or the second tray 72 by the relay reversal unit 60 or conveyed to the transfer device 44 again through the circulating path 54*a*.

(1) When, for example, an indication that the toner cartridges 49 are empty is displayed on the display unit 90*a* while the copying machine 1 carries out the instructed image forming operation, a user opens the front cover 11*a*. Even if the front cover 11*a* is opened, the copying machine 1 continues the image forming operation. The user replaces the toner cartridges 49 in a state in which the image forming operation is continued and closes the front cover 11*a*. The user can replace the toner cartridges 49 without suspending the image forming operation of the copying machine 1. Therefore, it is possible to prevent productivity of image formation from falling because of maintenance.

(2) When an indication of a sheet jam in the relay reversal unit 60 is displayed on the display unit 90*a* while the copying machine 1 carries out the image forming operation, the user opens the front cover 11*a*, pulls the drawing-out lever 102 of the bridge cover 101, and draws out the relay reversal unit 60 in the arrow m direction, which is the direction of the front side. The bridge detection switch 128 is turned off in a position where the relay reversal unit 60 is drawn out from the housing 11 by 2 mm. From the start of the drawing-out of the relay reversal unit 60 to the front side until the time when the relay reversal unit 60 reaches the position of 2 mm from the housing 11 where the bridge detection switch 128 is turned off, as shown in FIG. 7, for example, 30 msec is required. The motor driver 110 stops power supply to the first to third motors 96 to 98 according to an OFF signal of the bridge detection switch 128.

The user further draws out the relay reversal unit 60 to the front side while operation for stopping the power supply to the first to third motors 96 to 98 is performed. In a position where the relay reversal unit 60 is drawn out from the housing 11 by 7 mm, the first pusher 127 separates from the first terminal 120*a* of the interlock switch 120. The interlock switch 120 is turned off. From the time when the bridge detection switch 128 is turned off until the interlock switch 120 is turned off, as shown in FIG. 7, for example, 20 msec is required. The power supply to the first to third motors 96 to 98 is stopped in 20 msec. When an OFF signal of the interlock switch 120 is input to the motor driver 110, the motor driver 110 locks the driving of the first to third motors 96 to 98.

Simultaneously with the turning-off of the interlock switch 120, the first connector terminal 113*a* of the relay reversal unit 60 slips off from the second connector terminal 113*b*. The motor driver 110 and the first to third motors 96 to 98 are disconnected. The motor driver 100 detects that a plug slips off. However, since the power supply to the first to third motors 96 to 98 is already stopped, even if the motor driver 110 detects the slip-off of the plug, the motor driver 110 is unlikely to lock plug slip-off detection. Therefore, breakage of the driver substrate 110*a* due to the lock of the plug slip-off detection does not occur.

The user further draws out the relay reversal unit 60 from the housing 11 to eliminate a paper jam in a state in which the driving of the first to third motors 96 to 98 is locked. When the paper jam occurs in the first conveying path 51, the user releases the lock lever 103 to open the first conveying path 51 and eliminate the paper jam. When the paper jam occurs in the second conveying path 52, the user lifts the opening and closing lever 104 to eliminate the paper jam. After eliminating the paper jam, the user inserts the relay reversal unit 60 into the housing 11.

When the relay reversal unit 60 is slid from the front side to the inside of the housing 11, the first pusher 127 turns on the first terminal 120*a* of the interlock switch 120 in a position 7 mm before an inserting position. When an ON signal of the interlock switch 120 is input to the motor driver 110, the motor driver 110 unlocks a lock of the driving of the first to third motors 96 to 98. According to the unlock of the lock of the driving of the first to third motors 96 to 98, the motor driver 110 performs 24V power supply to the first to third motors 96 to 98.

Simultaneously with the turning-on of the interlock switch 120, the first connector terminal 113*a* of the relay reversal unit 60 is fit in the second connector terminal 113*b*. The motor driver 110 and the first to third motors 96 to 98 are connected to allow the driving by the control by the motor driver 110.

When the relay reversal unit 60 is further slid into the housing 11 and reaches a position 2 mm before the inserting position, the sheet metal 128*a* comes into contact with the bridge detection switch 128 and turns on the bridge detection switch 128. After inserting the relay reversal unit 60 in the housing 11, the user closes the front cover 11*a* and ends the paper jam eliminating operation for the relay reversal unit 60. When the interlock switch 120, the bridge detection switch 128, and the duplex unit detection switch 152 are on, READY is displayed on the display unit 90*a* and the copying machine 1 can perform the image forming operation.

(3) When an indication of a paper jam in the duplex paper feeding unit 81 is displayed on the display unit 90*a* while the image forming operation is carried out, the user rotates the side cover 80 in the arrow n direction to open the side of the housing 11. The second pusher 151 separates from the second terminal 120*b* of the interlock switch 120 to turnoff the interlock switch 120. According to an OFF signal of the interlock switch 120, the motor driver 110 stops the 24 V power supply to the first to third motors 96 to 98 and locks the driving of the first to third motors 96 to 98.

The user draws out the duplex paper feeding unit 81 in the side direction of the housing 11 to eliminate the paper jam in a state in which the driving of the first to third motors 96 to 98 is locked. After the elimination of the paper jam, the user inserts the duplex paper feeding unit 81 into the housing 11 and closes the side cover 80. The second pusher 151 of the side cover 80 turns on the second terminal 120*b* of the interlock switch 120. When an ON signal of the interlock switch 120 is input to the motor driver 110, the motor driver 110 unlocks locks of the first to third motors 96 to 98 and performs 24V power supply to the first to third motors 96 to 98. When the interlock switch 120, the bridge detection switch 128, and the duplex unit detection switch 152 are on, READY is displayed on the display unit 90*a* and the copying machine 1 can perform the image forming operation.

In this embodiment, the interlock switch 120 is switched according to the movement of the bridge cover 101 of the relay reversal unit 60. Even if the front cover 11*a* is opened, the interlock switch 120 is not switched. Therefore, it is possible to replace the toner cartridges 49 without suspending the image forming operation of the copying machine 1 and improve productivity during the image forming operation.

In this embodiment, the first to third motors 96 to 98 are connected to the motor driver 110 by using the drawer connector 113. Therefore, compared with the connection for drawing around wire harnesses, a reduction in space for connection and a reduction in cost can be obtained.

In this embodiment, the interlock switch 120 is switched according to the movement of the sheet conveying unit 87. Therefore, safety during maintenance can be obtained. When the interlock switch 120 is switched according to the movement of the relay reversal unit 60, after the power supply to the first to third motors 96 to 98 is stopped by turning off the cover detection switch 140, the interlock switch 120 is turned off. Even if the drawer connector 113 slips off simultaneously with the turning-off of the interlock switch 120 and the first to third motors 96 to 98 and the motor driver 110 are disconnected, the motor driver 110 is unlikely to lock plug slip-off detection and the driver substrate 110*a* is unlikely to be broken.

The invention is not limited to the embodiment and can be variously changed within the scope of the invention. For example, the timing of the first switch and the second switch is not limited to that explained in the embodiment. After the first switch is turned off according to the movement of the first conveying unit, power supply to the driving units only has to be stopped by the time when the second switch is turned off.

What is claimed is:

1. A sheet conveying unit for an image forming apparatus, comprising:

a first conveying unit that moves in a first direction with respect to an apparatus main body;

a second conveying unit that moves in a second direction with respect to the apparatus main body;

a first switch that detects attachment and detachment of the first conveying unit to and from the apparatus main body;

a second switch that locks driving of the first conveying unit and the second conveying unit;

a first actuator that actuates the first switch according to the movement of the first conveying unit; and a second actuator that turns off the second switch after turning-off operation for the first switch by the first actuator, according to the movement of the first conveying unit to remove the first conveying unit inserted in the apparatus main body.

2. The unit according to claim 1, wherein the first actuator and the second actuator are arranged in the first conveying unit.

3. The unit according to claim 1, wherein the first conveying unit has a terminal connected in a plug-in system to a driver fixed to the apparatus main body.

4. The unit according to claim 3, wherein the driver performs slip-off detection control to detect that the terminal slips off.

5. The unit according to claim 3, wherein the terminal is disconnected from a terminal of the driver after the first switch is turned off according to the movement of the first conveying unit.

6. The unit according to claim 3, wherein the second conveying unit is connected to the driver by an electric wire.

7. The unit according to claim 1, wherein the second switch is turned on and off according to the movement of the second conveying unit.

8. The unit according to claim 1, wherein the second actuator turns on the second switch before turning-on operation for the first switch by the first actuator according to the movement of the first conveying unit to insert the first conveying unit in the apparatus main body.

9. An image forming apparatus comprising:

an image forming unit;

an apparatus main body that holds the image forming unit;

a first conveying unit that moves in a first direction with respect to the apparatus main body;

a second conveying unit that moves in a second direction with respect to the apparatus main body;

a driver that is arranged in the apparatus main body and controls driving units for the first conveying unit and the second conveying unit;

a first switch that detects attachment and detachment of the first conveying unit to and from the apparatus main body;

a second switch that locks driving of the first conveying unit and the second conveying unit;

a first actuator that actuates the first switch according to the movement of the first conveying unit; and a second actuator that turns off the second switch after turning-off operation for the first switch by the first actuator, according to the movement of the first conveying unit to remove the first conveying unit inserted in the apparatus main body.

10. The apparatus according to claim 9, wherein the first conveying unit and the driver are connected in a plug-in system, and the driver performs slip-off detection control for detecting that the driving unit slips off.

11. The apparatus according to claim 10, wherein the driving unit for the first conveying unit and the driver are disconnected after the first switch is turned off according to the movement of the first conveying unit.

12. The apparatus according to claim 10, wherein the second conveying unit is connected to the driver by an electric wire.

13. The apparatus according to claim 9, wherein the first actuator and the second actuator are arranged in the first conveying unit.

14. The apparatus according to claim 9, wherein the second switch is turned on and off according to the movement of the second conveying unit.

15. The apparatus according to claim 9, wherein the apparatus main body includes, on a front side in a moving direction of the first conveying unit, a front cover and a third switch that detects opening and closing of the front cover.

16. The apparatus according to claim 9, wherein the second actuator turns on the second switch before turning-on operation for the first switch by the first actuator according to the movement of the first conveying unit to insert the first conveying unit in the apparatus main body.

* * * * *